United States Patent [19]

Niemi

[11] Patent Number: 4,586,661

[45] Date of Patent: May 6, 1986

[54] PRESSURE CHAMBER GRINDER EQUIPMENT

[76] Inventor: Jouko Niemi, SF-33960 Pirkkala, Finland

[21] Appl. No.: 674,157

[22] PCT Filed: Mar. 5, 1984

[86] PCT No.: PCT/FI84/00021

§ 371 Date: Nov. 2, 1984

§ 102(e) Date: Nov. 2, 1984

[87] PCT Pub. No.: WO84/03455

PCT Pub. Date: Sep. 13, 1984

[30] Foreign Application Priority Data

Mar. 4, 1983 [FI] Finland ..... 830740

[51] Int. Cl.[4] ..... B02C 19/06

[52] U.S. Cl. ..... 241/34; 241/39; 241/65; 241/80; 241/152 R

[58] Field of Search ..... 241/152 R, 30, 34, 98, 241/5, 39, 65, 79.1

[56] References Cited

U.S. PATENT DOCUMENTS 2,596,088 5/1952 Trost et al. ..... 241/39

4,034,919 7/1977 Akunov et al. ..... 241/39

FOREIGN PATENT DOCUMENTS 62235 12/1982 Finland .

63869 9/1983 Finland .

*Primary Examiner*—Mark Rosenbaum

*Attorney, Agent, or Firm*—McGlew and Tuttle

[57] ABSTRACT

The present invention is concerned with a pressure chamber grinder equipment in which finely divided material is ground to ultra-finely divided particles at each other at an elevated pressure. The objective of the invention is to achieve maximal economies of energy and an optimal grinding process. The invention is characterized in that the equipment comprises at least one horizontal plug pipe (1) provided with a feeder funnel and with a push cylinder (2), a pressurized equalizing tank (3) connected to the plug pipe (3), a screw conveyor (4) being passed across the bottom portion of the tank (3) for the purpose of feeding the material in a loose state into a pre-grinder (6), at whose outlet side the material-gas flow is divided into component flows of precisely equivalent speed and composition, which component flows are passed each through a grinding nozzle (10) of its own, of the shape of a venturi tube, into the grinding chamber proper, the nozzles being directed conically towards each other. At the outlet side of the grinder chamber, there is a classifier that returns the coarse fraction straight into the grinding zone in the grinding chamber.

5 Claims, 5 Drawing Figures

PRESSURE CHAMBER GRINDER EQUIPMENT

FIELD AND BACKGROUND OF THE INVENTION

The present invention is concerned with a pressure chamber grinder equipment in which finely divided material is ground to ultra-finely divided particles by means of grinding-gas-material jets directed at each other by using a high starting pressure and temperature.

The objective of the invention has been to achieve maximal economies of energy in the use of the jet grinding technique as well as a highly controlled and optimal grinding process in the grinding zones of the equipment.

The most commonly used feeder device in jet grinders is an ejector, which is highly unsatisfactory in particular in view of energy economy. When an ejector is used, material to be ground is shifted into the grinding chamber by means of a gas jet. Thereat, considerable quantities of air are also sucked into the grinder through the feeder funnel of the feeder device, which has a detrimental effect in particular on the grinding result and also on the heat economy, for energy is lost in heating and compressing the extra air. At the same time, the ejector device imposes high requirements on the consistency of the material to be ground. In an ejector feeder, about 20 per cent of the overall energy consumption of the grinding process is used, being consumed mainly in order to produce the difference in pressure.

In order to eliminate the problems mentioned above, in the U.S. Pat. No. 2,596,088 a mechanical feeder has been suggested in which the material to be ground is fed into the jet grinder exclusively by means of a screw conveyor so that the screw conveyor forms a material plug in the feeder pipe right before the inlet opening of the grinder, so that the compressed and possibly slightly clodded material plug is pushed into the grinder. Another alternative in the said patent publication is the use of a push piston instead of the screw conveyor, in which case the problems are avoided that are experienced when a screw conveyor is used against a considerable pressure resistance. On the other hand, a problem related to the use of a push piston is the uneven feed of the material, for whose improvement it is suggested that two feeder pipes be used, without, however, succeeding in a total elimination of this problem, for the material feed cannot be equalized to a sufficient extent by just increasing the number of feeder pipes. Moreover, the compact material plug fed into the grinder must be broken by means of the grinding gas, which has a highly detrimental effect on the grinding process proper. The material must not be fed into the grinder as large clods, for thereby the grinding process is interrupted for a moment, which is emphasized even more clearly if it is taken into account that the material stays in the grinder just a few hundredths of a second.

In the apparatus in accordance with the Finnish Pat. No. 62,235, U.S. Pat. No. 4,422,579 is used for breaking up the material plug and for equalizing the feed, which has proved a usable solution. By means of this feeder, the material particles are introduced into the grinder in a relatively free form, so that the grinding process goes on without disturbance all the time. However, it is a drawback of the feeder device that even a little disturbance in the feed at the push pistons has an immediate effect on the rate of feed of the material entering into the grinding chamber, which has a disturbing effect on the grinding process.

On the other hand, it has been noticed that the traditional jet grinders are not entirely satisfactorily suitable for such a mechanical feeder system, which is in itself of a very good energy economy. That is why, for example, in the Finnish Patent No. 63,869 (U.S. Patent application Ser. No. 518,800) now U.S. Pat. No. 4,546,926 a grinder device of a new type has been suggested, which comprises a pre-grinding chamber and a grinding chamber proper, which are in connection with each other via at least two Laval nozzles which form an angle with each other and between which nozzles a collision zone is formed for the material-gas flows ejected out of the nozzles and into which collision zone the coarse fraction coming from the classifier installed at the outlet side of the grinder is also returned directly. It is a prerequisite for trouble-free operation of such an apparatus that even the material particles in the material-gas flow reach an ultrasonic velocity in the grinding nozzles of the apparatus and that the material-gas flow is equivalent in each grinding nozzle both regarding its magnitude and regarding its composition. During the use of the apparatus, it has, however, been noticed that in certain cases it is difficult to keep the material to be ground in a sufficiently fluid state in the pregrinder in order that the distribution of the material-gas flow into equivalent component flows should be completely successful, which for its part makes an optimal feeding of the material to be ground into the grinder device more difficult. If, for some reason, imbalance occurs in the flows in the grinding nozzles, so that the collision zone of the material particles is shifted off out of its optimal position at the middle of the grinder chamber, serious abrasion damage is readily produced in the walls of the grinding chamber.

SUMMARY OF THE INVENTION

By means of the pressure chamber grinder equipment in accordance with the present invention, attempts have been made to eliminate all of the drawbacks mentioned above. The pressure chamber grinder equipment concerned is characterized in that it comprises

- at least one, substantially horizontal so-called plug pipe provided with a feeder funnel, the free end of the plug pipe being provided with a push cylinder operating in the longitudinal direction of the plug pipe so as to compact the material to be ground into gas-tight plug and to feed it,
- a pressurized equalizing tank at whose upper part all the plug pipes end,
- a screw conveyor that is passed across the bottom portion of the equalizing tank so that its outlet side is jointly operative with the outlet pipe of the equalizing tank,
- a pre-grinder connected to the outlet pipe, which pre-grinder is provided with substantially tangentially directed grinding-gas nozzles,
- an apparatus installed at the outlet side of the pre-grinder for dividing the material-gas flow coming from the pre-grinder into two flows of equivalent magnitude and composition, both of which flows are possibly passed through one or several further distributor devices of their own, placed one after the other, so as to obtain a desired number of equivalent component flows,
- a grinding chamber proper, into which each equivalent component flow is passed through a grinding nozzle of its own, the shape of the nozzle being preferably that of a venturi tube, which nozzles are directed substantially conically towards each other so that a collision zone of material-gas jets is formed at the middle of the grinding chamber, a classifier, which is connected to the outlet opening of the grinding chamber, in which classifier the outlet opening for the coarse fraction is connected straight to the said grinding chamber and whose outlet opening for the fine fraction is connected to the collecting container for finished product.

The further characteristics of the invention are defined in the attached patent claims.

BRIEF DESCRIPTION OF THE DRAWINGS

In the following, the invention will be described in more detail with reference to the attached drawings, wherein.

DESCRIPTION OF THE PREFERRED EMBODIMENT

Figures 1, 4, 5:
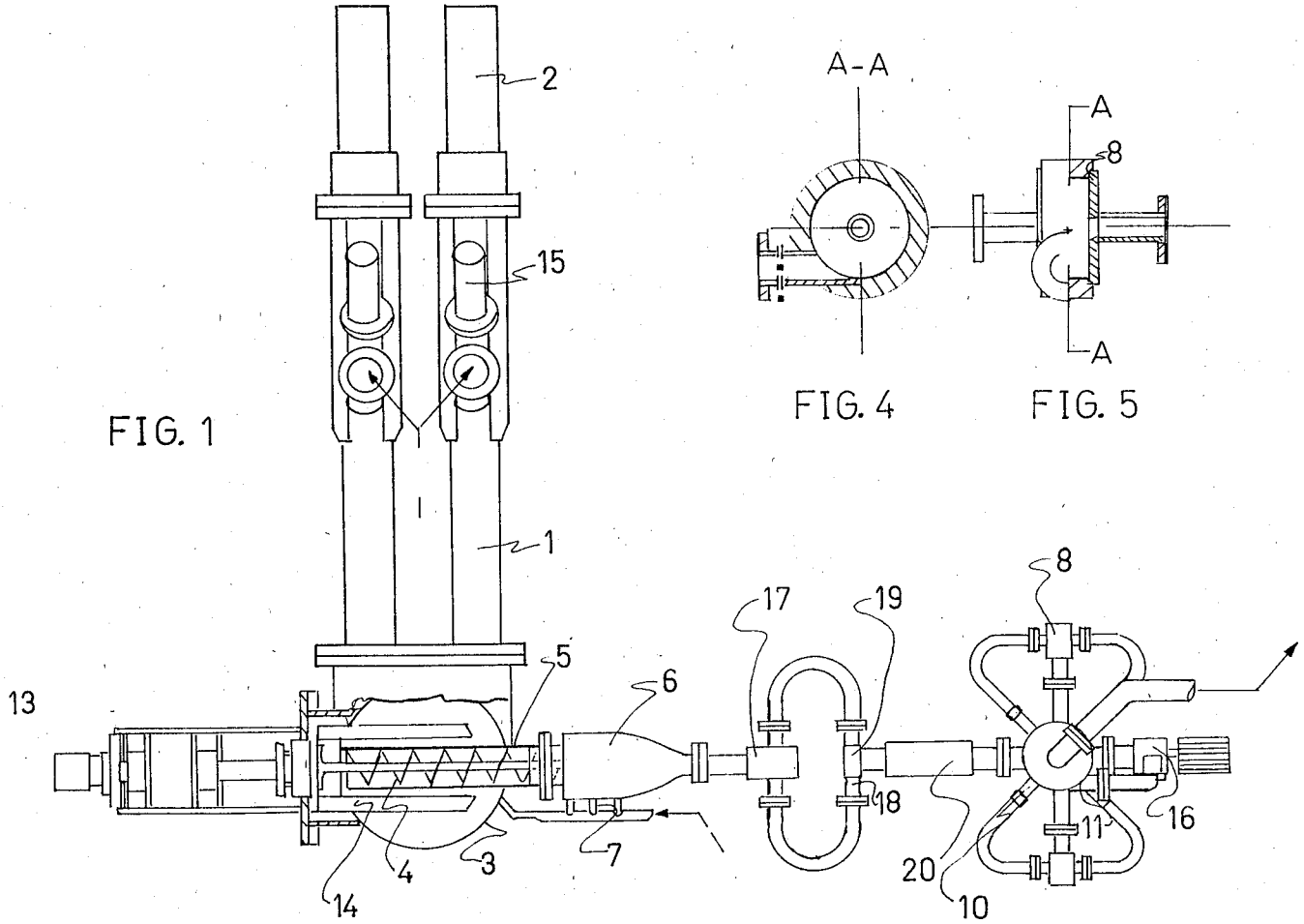
FIG. 1 shows an example of an apparatus in accordance with the invention, as viewed from above, partly in section.
FIG. 4 shows an example of a device for dividing the material-gas flow into two component flows, as a side view with one side end removed.
FIG. 5 shows a partial sectional view of the device in FIG. 4.
Figure 2:
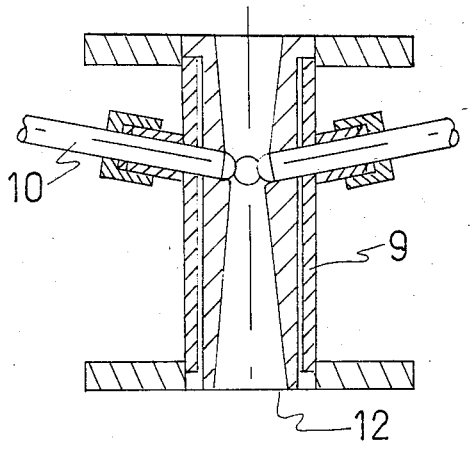
FIG. 2 is an enlarged view of a section through the grinding chamber proper along its longitudinal axis.
Figure 3:
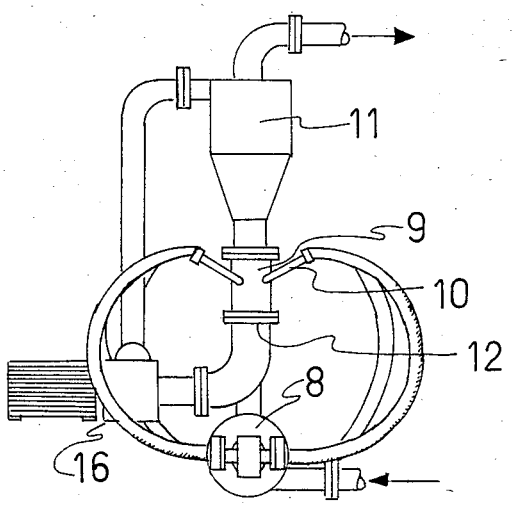
FIG. 3 shows the grinding chamber proper and the classifier in a side view, and taken along line A—A of FIG. 5.

The pressure chamber grinder equipment comprises one or several, substantially horizontal socalled plug pipes 1 provided with feeder funnels. At the free end of each plug pipe 1, a push cylinder 2, operating in the longitudinal direction of the plug pipe, is provided for compacting the material to be ground into a gas-tight plug and for feeding it. The plug pipe 1 ends in the upper part of a pressurized equalizing tank 3, whereby the compressed and possibly slightly clodded material plug falls down towards the bottom of the equalizing tank and is at least partly broken, the material being brought to an intermediate storage in the tank 3. Across the bottom part of the equalizing tank 3, a screw conveyor 4 is installed so that the outlet end of the screw conveyor is jointly operative with the outlet pipe 5 of the equalizing tank. The screw conveyor is arranged so that it breaks up and loosens the possibly clodded material and feeds the material as a uniform flow into a pre-grinder 6 connected to the outlet pipe 5 of the equalizing tank, in which pre-grinder 6 substantially tangentially directed grinding-gas nozzles 7 have been installed. Since the screw conveyor 4 does not have to work against any pressure resistance, the material to be ground remains in the loose state when it is shifted into the pre-grinding chamber 6. In the pre-grinder 6, high-pressure and superheated grinding gas is mixed into the material to be ground via the tangentially directed grinding-gas nozzles 7, whereat the material is also ground to some extent. At the outlet side of the pre-grinder 6, an apparatus 8 is installed for dividing the material-gas flow coming from the pre-grinder into two flows of equivalent magnitude and composition, both of the said flows being possibly passed through one or several further devices of distribution (8) of their own, placed one after the other, so as to obtain a desired number of equivalent component flows. Each equivalent component flow is passed through a grinding nozzle 10 of its own, preferably of the shape of a venturi tube, into the grinding chamber 9 proper of the equipment. The grinding nozzles 10 are directed substantially conically towards each other so that at the middle of the grinding chamber 9, at the imaginary junction of the grinding nozzles 10, a collision zone of the material-gas flows is formed, where the highly efficient grinding proper takes place. The highly accurate distribution of the material-gas flow into equivalent component flows guarantees that the material-gas jet coming from each nozzle is of equal velocity and composition. This ensures that the colliding of the particles against each other takes place highly efficiently and within a very narrow area. To the outlet opening 12 of the grinding chamber 9, a classifier 11 is connected whose outlet opening for the coarse fraction is connected directly with the grinding chamber 9 and whose outlet opening for the fine fraction is connected to the collecting container for the finished product (not shown).

It is advantageous that the equipment has two plug pipes 1, which may have a common feeder funnel, which is provided with a driven, pivotable gate that closes the feed opening of the plug pipe 1 whose push cylinder 2 is at that time performing a pushing and returning movement. At that time, material is being fed into the other plug pipe 1 ahead of its push cylinder 2. When the first-mentioned push cylinder 2 has completed its feeding movement, the gate is pivoted to the other side, whereat the material fed into it is, at the same time, pre-compressed.

In view of regulating the feeding of the material to be ground so that in the pre-grinder 6 of the grinder equipment there is all the time an optimal quantity of the material to be ground, it has proved preferable to connect the drive motor 13 of the feeder screw 4 to a control system regulating its running speed, which control system has been arranged so that it operates on the basis of impulses received from the variations in the intermediate pressure prevailing in the pre-grinder 6, while assuming that the inlet pressure of the grinding gas is constant. The intermediate pressure prevailing in the pre-grinder 6 is, viz., thereat dependent on the material quantity fed into the pre-grinder.

In the pressure chamber grinding apparatus concerned, a very high starting pressure is used, whereby a very high compression force acts upon the material fed into the equalizing tank 3 as a gas-tight plug, so that a sufficient loosening of the material is not achieved by means of the decomposing effect of the screw conveyor 4 alone. This is why it is preferable to install a rotor 14 having radial wings into the equalizing tank 3, which rotor is attached to the shaft of the screw conveyor 4 and surrounds the screw conveyor 4 proper.

The length of the grinding nozzles 10, preferably of the shape of a venturi tube, must be selected in accordance with the particle size of the material to be ground. The larger the particle size, the longer shall the grinding tube be. In view of the manufacture and maintenance, it has proved preferable to make the nozzles, e.g., out of three parts so that two parts constitute the two conical parts of the nozzle and the third part constitutes the narrowest part in the nozzle.

In order to obtain a sufficient circulation between the grinding chamber 9 and the classifier 11 connected to it, it is preferable to use a grinding chamber 9 of the shape of a venturi tube, in which case the grinding nozzles 10 penetrate into the narrowest point of the grinding chamber 9, at which point the collision zone of the material particles is also formed.

In order to compact the material to be ground into a gas-tight plug, a very powerful push cylinder 2 is required. In order that the efficiency of this push cylinder could be kept as high as possible, it is preferable to perform the compacting of the material at two or more stages. This is achieved, e.g., by means of an additional push cylinder 15, which is arranged so that it operates in the inclined pipe connecting the feeder funnel with the plug pipe 1. The function of the additional push cylinder 15 is to produce a preliminary compacting of the material to be ground. If necessary, the feeder funnel may additionally be provided with a vibrator device, by whose effect some of the air contained in the material is removed out of it and the material is compacted to some extent.

In order to improve the material-gas circulation between the grinding chamber 9 proper and the classifier 11, a blower 16 may be installed in the pipeline connecting the outlet opening of the grinding chamber 9 with the classifier 11.

The grinding of some material is advantageously carried out, e.g., in three subsequent steps. In such a case, an intermediate grinder 18 provided with a distributor 17 of material-gas flow of its own can be installed between the pre-grinder 6 and the grinding chamber 9 proper. In order that the grinding gas should still have an adequate energy content after the grinding stage proper, it is preferable to install an intermediate superheater 20 at the outlet side of the intermediate grinder 19. The intermediate grinder 19 may be provided, e.g., with two grinding nozzles 18 directed at each other.

What is claimed is:

1. Pressure chamber grinder equipment in which finely divided material is ground to ultra-finely divided particles by means of grinding-gas-material jets directed at each other and by using a high starting pressure and temperature, comprising at least one, substantially horizontal plug pipe provided with a feeder funnel, said plug pipe having a free end, a push cylinder operable at the free end of the plug pipe in a longitudinal direction of the plug pipe for compacting material to be ground into a gas-tight plug and for feeding the plug, a pressurized equalizing tank having an upper part connected to said plug pipe, a bottom portion and an outlet pipe, a screw conveyor for breaking up the plug and feeding the material, extending across the bottom portion of said equalizing tank and having an outlet side which is operatively connected in the outlet pipe of said equalizing tank for feeding the material out of said equalizing tank, a pre-grinder connected to the outlet pipe for receiving material therefrom and having substantially tangentially directed grinding-gas nozzles, said pre-grinder having an outlet side, at least one distributor device connected to the outlet side of said pre-grinder for dividing a material-gas flow coming from said pre-grinder into two flows of equivalent magnitude and composition, a grinding chamber having a plurality of grinding nozzles directed substantially conically toward each other so that a collision zone of material-gas jets is formed at a middle of said grinding chamber, each equivalent flow being passed through a grinding chamber grinding nozzle of its own, said grinding chamber having an outlet opening, a classifier connected to the outlet opening of said grinding chamber, the classifier being provided with a first outlet opening for a coarse fraction, which first outlet opening is connected directly to said grinding chamber, and a second outlet opening for a fine fraction, which second outlet opening is connected for discharging ultra-finely divided material as a finished product, said screw conveyor having a shaft, a rotor having radial wings and being connected to said shaft of said screw conveyor, said radial wings surrounding said screw conveyor, a drive motor connected to said shaft for rotating said rotor and for rotating said screw conveyor, and a control system for regulating a running speed of said motor, said control system being arranged to operate on the basis of impulses corresponding to variations in an intermediate pressure prevailing at the outlet side of said pre-grinder when an inlet pressure of grinding gas to the pre-grinder is held constant.

2. Pressure chamber grinder equipment as claimed in claim 1, wherein the grinder chamber has the shape of a venturi tube and that the grinding nozzles thereof are placed at a narrowest point of the tube, at which the collision zone is formed.

3. Pressure chamber grinder equipment as claimed in claim 2, wherein the compacting of the material to be ground into a gas-tight plug takes place in at least two steps, by means of a compacting cylinder operating in an inclined pipe connecting the feeder funnel with the plug pipe.

4. Pressure chamber grinder equipment as claimed in claim 2 or 3, wherein a pipeline between the outlet opening of the grinding chamber (11) proper and the classifier (11) is provided with a blower for improving the circulation of material.

5. Pressure chamber grinder equipment as claimed in claim 4, wherein between the pre-grinder and the grinding chamber, an intermediate grinder is installed that is provided with a material-gas-flow distributor device of its own and with grinding nozzles directed substantially towards each other, as well as, at an outlet side of the intermediate grinder, an intermediate superheater.

* * * * *